US009056496B2

(12) United States Patent
Van Beek et al.

(10) Patent No.: US 9,056,496 B2
(45) Date of Patent: Jun. 16, 2015

(54) RECORDING SUBSTRATE TREATMENT APPARATUS, PRINTING SYSTEM AND METHOD OF DRYING

(71) Applicant: OCE-TECHNOLOGIES B.V., Venlo (NL)

(72) Inventors: Albert M. Van Beek, Eindhoven (NL); Peter J. Hollands, Baarlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/478,617

(22) Filed: Sep. 5, 2014

(65) Prior Publication Data

US 2014/0375737 A1 Dec. 25, 2014

Related U.S. Application Data

(63) Continuation of application No. PCT/EP2013/053425, filed on Feb. 21, 2013.

(30) Foreign Application Priority Data

Mar. 6, 2012 (EP) ..... 12158187

(51) Int. Cl.
*B41J 2/01* (2006.01)
*B41J 11/00* (2006.01)

(52) U.S. Cl.
CPC ..... *B41J 11/002* (2013.01); *B41J 11/0085* (2013.01); *B41J 2/01* (2013.01)

(58) Field of Classification Search
CPC ..... B41J 11/0015; B41J 11/002; B41J 2/01; B41J 11/007; B41J 29/17; B41J 29/377; B41M 7/0081
See application file for complete search history.

(56) References Cited

U.S. PATENT DOCUMENTS

| | | | |
|---|---|---|---|
| 7,354,146 | B2 | 4/2008 | Yraceburu et al. |
| 2005/0092200 | A1 | 5/2005 | Beauchamp et al. |
| 2008/0158324 | A1 | 7/2008 | Yraceburu et al. |

*Primary Examiner* — Lisa M Solomon
(74) *Attorney, Agent, or Firm* — Birch, Stewart, Kolasch & Birch, LLP

(57) ABSTRACT

A recording substrate treatment apparatus includes a transporting mechanism for transporting a sheet of a recording substrate; a suction device to provide an underpressure force at an outer surface of the transporting mechanism arranged for holding down a sheet of a recording substrate; a heater for directly heating the recording substrate; and a blower for providing a flow of a gaseous medium at the outer surface of the transporting mechanism, wherein in operation the blower receives the gaseous medium from the suction device.
The present invention also pertains to a printing system comprising such a recording substrate treatment apparatus and a method of drying a recording substrate using such a recording substrate recording apparatus.

19 Claims, 5 Drawing Sheets

RECORDING SUBSTRATE TREATMENT APPARATUS, PRINTING SYSTEM AND METHOD OF DRYING

CROSS-REFERENCE TO RELATED APPLICATIONS

This application is a Continuation of International Application No. PCT/EP2013/053425, filed on Feb. 21, 2013, and for which priority is claimed under 35 U.S.C. §120. PCT/EP2013/053425 claims priority under 35 U.S.C. §119(a) to Application No. 12158187.0, filed in Europe on Mar. 6, 2012. The entire contents of each of the above-identified applications are hereby incorporated by reference into the present application.

BACKGROUND OF THE INVENTION

1. Field of the Invention

The present invention relates to a recording substrate treatment apparatus, in particular a recording substrate treatment apparatus for a printer or copier. For example, the recording substrate treatment apparatus comprises at least one of a drying device for drying a re-cording substrate and a fixing device for fixing a printing substance on a recording substrate. For example, the fixing device may be or comprise a fuser. The present invention further relates to a printer or printing system comprising a recording substrate treatment apparatus.

2. Description of Background Art

In the field of copying and printing, it is known to dry or fix prints on a recording substrate. For example, a fuser is known for fixing toner powder to a printing substrate, such as a sheet of paper. For example, a fuser comprises a radiant heat lamp, which may be arranged to heat a printing substrate support roller for heating and bonding the toner to the paper.

Fixation of a printing substance to a recording substrate usually involves heating the recording substrate comprising the printing substance and evaporating a solvent and/or water stemming from the printing substance (e.g. an ink).

In inkjet printing, in particular water based inkjet printing on flexible absorbing recording substrates (such as plain paper and machine or offset coated paper), deformation of the recording substrate may occur upon drying of the recording substrate and/or fixation of the printed image on the recording substrate. Such deformation may, at least in part, be prevented by rigidly fixing a recording substrate during drying and fixation. For example, a sheet of a recording substrate may be rigidly fixed on a transportation mechanism by an underpressure force induced by a suction device. The resulting suction flow where no recording substrate is present may have an unwanted cooling effect on the transportation mechanism, leading to energy loss. Recirculation of the suction flow to the recording substrate treatment apparatus may prevent excessive energy loss. However, when recirculating the suction flow (of a gaseous medium, in particular air) build-up of vaporous components in the circulating gaseous medium and originating from the printing substance may occur. Hence, the drying capacity of the recording substrate treatment apparatus deteriorates. Removing such vaporous components requires cooling of the circulating gaseous medium in order to condensate the vaporous components, which again causes an energy loss.

In U.S. Pat. No. 7,354,146, structures and methods are disclosed for at least partially forming an image on a recording substrate on a platen, directing air from a dryer at the platen, and recirculating the air from the platen back to the dryer. Sheets of a recording substrate are held down by an underpressure force. The resulting suction flow may be used to cool the electronics of the printer and is optionally heated before being impinged on the recording substrate to facilitate drying of the recording substrate. A condenser is used to remove vaporous components from the circulating gaseous medium.

It is a disadvantage of recording substrate treatment apparatuses known from the background art that the printed recording substrates are solely dried with a flow of a heated gaseous medium, which is an indirect method of heating. Such recording substrate treatment apparatuses are not suitable for use in a highly productive printer, because of the limited drying capacity of such recording substrate treatment apparatuses.

It is another disadvantage that the entire circulating flow of the gaseous medium needs to be cooled down to remove vaporous components, which is energy inefficient.

In U.S. Patent Application Publication No. 2005/0092200, a printing apparatus is disclosed including a drum having a peripheral surface. In operation of the printing apparatus, a source of heat is used to dry or partially dry any ink that is laid down or placed on the media, which is located on the outer peripheral surface of the print drum. The source of heat is arranged inside the drum and heats the inside surface of the drum.

It is a disadvantage of the printing apparatus disclosed in U.S. Application Publication No. 2005/0092200, because it provides a relatively slow heating method, which is less suitably applied in highly productive printers or printing systems.

SUMMARY OF THE INVENTION

It is therefore an object of the present invention to provide a recording substrate treatment apparatus that is suitable for use in a highly productive printer or printing system, which has a large drying capacity.

It is another object of the present invention to provide a recording substrate treatment apparatus for use in a highly productive printer or printing system, which is energy efficient.

In order to facilitate achieving one or more of these objects, according to an embodiment of the present invention, there is provided a recording substrate treatment apparatus, comprising: a transporting mechanism configured to transport a sheet of a recording substrate; a first suction device configured to provide an underpressure force at an outer surface of the transporting mechanism to hold the recording substrate on the outer surface; a heater configured to directly heat the recording substrate; and a blower configured to provide a flow of a gaseous medium at the outer surface of the transporting mechanism, wherein, in operation, the blower receives the gaseous medium from the first suction device.

The heater configured to directly heat the recording substrate may be a radiation heater, such as medium-wave and carbon (CIR) infrared heaters which operate at filament temperatures of around 1000° C. They reach maximum power densities of up to 60 kW/m$^2$ (medium-wave) and 150 kW/m$^2$ (CIR).

Directly heating of a sheet of recording substrate in the context of the present invention should be construed as transferring thermal energy (heat) to the sheet of the recording substrate mainly by conduction (e.g. with a heated platen) and/or radiation (e.g. with a radiation heater). Convective heat transport (e.g. via a gaseous medium) may have a contribution to the heating of the recording substrate. However, such contribution is small relative to heating by conduction and/or radiation. Therefore, heating of the recording substrate mainly by circulating a hot (gaseous) medium, e.g. hot air is not considered to be a form of direct heating in the context of the present invention.

The use of a heater for directly heating the recording substrate significantly improves the drying capacity of a recording substrate treatment apparatus. The recording substrate treatment apparatus can therefore be suitably used in a highly productive printer or printing system.

Heating by conduction (e.g. with a heated platen) may be relatively slow, in particular when compared to direct heating with radiation. Therefore direct radiation heating of a sheet of recording substrate in a highly productive printer or printing system is preferred. It is an additional advantage of direct heating by radiation that by switching off the radiation heaters, the heating of the substrate may be immediately stopped. This may be particularly advantageous in cases of calamities in the printing process, e.g. paper jams. Paper jams may cause accumulation of sheets of recording substrate, e.g. paper, in the recording substrate treatment apparatus. In highly productive printing processes, large amounts of heat are supplied to a large number of sheets of recording substrate, which increases the risk of fire in case of a calamity. Directly stopping of the thermal energy supply to the print substrates prevents these sheets from overheating or even catching fire.

In an embodiment, the blower comprises an impingement unit arranged for refreshing the gaseous medium at the outer surface of the transporting mechanism.

An advantage of the present embodiment is that by impinging a flow of the gaseous medium on the surface of a printed (and hence wet) recording substrate, the stationary and/or laminar boundary layer of the gaseous medium on the surface of the drying printed recording substrate is broken. Such boundary layer contains a relative high amount of vaporous components due to evaporation of such components from the surface of the recording substrate. In extreme cases, such a boundary layer is saturated with vaporous components. Further evaporation of said components is therefore hindered, which thus limits the drying capacity of the recording substrate treatment apparatus. By impinging a flow of the gaseous medium on the surface of the printed recording substrate, the boundary layer is broken down and refreshed with gaseous medium containing no or less vaporous components. The drying capacity of the recording substrate treatment apparatus is therefore increased.

In an embodiment, at least a part of the flow of the gaseous medium provided by the blower is, in operation, guided to the heater.

An advantage of this embodiment is that a part of the flow of the gaseous medium provided by the blower is used to cool the heater and prevents the heater from getting overheated. On the other hand, the waste heat of the heaters (i.e. the heat that is not directly used to heat the recording substrate) is used to heat the gaseous medium, which increases the saturation pressures of vaporous components in the gaseous medium and hence the drying capacity.

In an embodiment, the recording substrate treatment apparatus comprises a second suction device arranged opposite an outer surface of the transporting mechanism for removing the gaseous medium from the outer surface of the transporting mechanism, and wherein in operation the blower receives the gaseous medium from the second suction device.

In operation, the first suction device provides an underpressure force at an outer surface of the transporting mechanism, for holding down a sheet of a recording substrate. The actual flow generated by the first suction device depends on the number of sheets that are present on the outer surface of the transporting mechanism. For example, if the outer surface of the transporting mechanism would be entirely covered with sheets of recording substrate, the flow generated by the first suction device would be zero or close to zero. The amount of gaseous medium received by the blower may become too low to perform proper impingement and proper cooling of the heaters as described above. The drying capacity of the recording substrate treatment apparatus decreases because of insufficient refreshment of the boundary layer at the outer surface of the transporting mechanism. The heaters are insufficiently cooled which may lead to overheating or the power of the heaters must be reduced to prevent overheating, which limits the drying capacity of the recording substrate treatment apparatus.

To compensate for this, a second suction device may be provided for, which is arranged opposite the outer surface of the transporting mechanism and removes gaseous medium from the outer surface of the transporting mechanism. The second suction device therefore assists in refreshing the gaseous medium on the outer surface of the transporting mechanism, where in operation, a sheet of recording substrate is present.

In an embodiment, the recording substrate treatment apparatus comprises a discharge device configured to discharge a portion of the gaseous medium before it is received by the blower.

In the recording substrate treatment apparatus according to an embodiment of the present invention, which is a more or less closed system, the amount of vaporous components originating from the printing substance (e.g. ink) in the gaseous medium may increase. The closer said amount is to the saturation amount of said components in the gaseous medium, the more difficult further evaporation of said components becomes. Therefore, the drying capacity of the recording substrate treatment apparatus decreases. Usually, the vaporous components are removed from the circulating gaseous medium by, e.g. condensation. This requires cooling of the gaseous medium, which is not energy efficient. Alternatively, complex installations are required to recover the energy and transfer it back to the substrate treatment apparatus.

The present inventors have found that by discharging a small amount of the gaseous medium out of the substrate treatment apparatus, the amount of vaporous components can be kept well below the saturation amounts in the gaseous medium. In particular, at relatively high temperatures of the recirculating gaseous medium (e.g. 60° C. to 100° C.), a discharge of 10% of the circulating gaseous medium enables the saturation level of the gaseous medium with vaporous components to be kept below 40%, preferably between 10% and 20%, even at high printing speeds (e.g. 300 A4 pages per minute) and high marking substance coverage (e.g. 11 g/m2 or higher).

By discharging an amount of the gaseous medium from the recording substrate treatment apparatus, the pressure inside the apparatus decreases. Gaseous medium present in the surroundings of the substrate treatment apparatus may leak into the recording substrate. Gaseous medium of ambient conditions (e.g. temperature and vaporous component content) mixes with the gaseous medium present in the recording substrate treatment apparatus.

In an embodiment, the recording substrate treatment apparatus comprises a supply duct for supplying fresh gaseous medium to the blower.

It is an advantage of this embodiment that the inflow of gaseous medium into the recording substrate treatment device can be controlled. Gaseous medium of ambient conditions may be pretreated (e.g. condensed and/or heated) before being mixed with the gaseous medium present in the recording substrate treatment apparatus.

In an embodiment, the recording substrate treatment apparatus comprises a pressure sensor arranged to measure the pressure in a flow of the gaseous medium generated by the blower and to control a flow rate of the gaseous medium generated by the second suction device.

The measured pressure in the flow of the gaseous medium generated by the blower is an indication of the flow rate of the gaseous medium generated by the blower and hence an indication of the degree of occupation of the outer surface of the transporting mechanism by sheets of the recording substrate. Said pressure may therefore be used to control the flow rate of the gaseous medium generated by the second suction device in order to prevent the drying capacity of the recording substrate apparatus to decrease and to prevent the heaters from overheating, as described above. The pressure in the flow and hence the flow rate of the flow of the gaseous medium generated by the blower may therefore be controlled within a predetermined range.

In an embodiment, the recording substrate treatment apparatus comprises a sensor arranged to measure the amount of a vaporous component present in the gaseous medium to be received by the blower and to control a discharge portion of the gaseous medium.

In an further embodiment, wherein the vaporous component comprises water vapor, the sensor may be a humidity sensor, in particular a relative humidity sensor.

The amount of the vaporous component, or vaporous components of the combined flows of the gaseous medium generated by the first suction device and the second suction device may be determined before said combined flow is received by the blower. The amount of vaporous components is then controlled within a predetermined range, e.g. between 30% and 50% saturation, by controlling the discharge portion of the gaseous medium as described above.

In an embodiment, the recording substrate treatment apparatus comprises a purifier arranged to purify the gaseous medium, wherein the purifier is preferably arranged to receive the discharge portion of the gaseous medium.

The purifier is arranged to remove impurities present in the gaseous medium before discharging the gaseous medium (e.g. to the environment) or reusing it in the recording substrate treatment apparatus or anywhere else in the printing system.

In an embodiment, the recording substrate treatment apparatus comprises an energy transfer system for recovering energy from the gaseous medium, wherein the energy transfer system is preferably arranged to receive the discharge portion of the gaseous medium.

The energy transfer system may be arranged to recover the (latent) energy present in the discharge portion of the gaseous medium and reuse such energy in the substrate treatment apparatus or anywhere else in the printing system.

In an embodiment, the energy transfer system comprises a condenser for removing a vaporous component, in particular water vapor, from the gaseous medium. The gaseous medium is cooled (i.e. the energy is transferred and preferably reused in the recording substrate treatment apparatus or anywhere else in the printing system) and the vaporous components condensate and are separated from the gaseous medium. The gaseous medium leaving the condenser (preferably the discharge portion of the gaseous medium) is therefore cool and virtually free of vaporous components. Condensation on any parts of the printing system is thus prevented or at least mitigated.

In an embodiment, the condenser comprises a heat exchanger adapted for condensing liquid from a gaseous medium at a first side of the heat exchanger and for providing energy from latent heat, which is released by said condensing of liquid, at a second side of the heat exchanger, the second side being separate from said first side. Thus, the condenser may provide cooled gaseous medium and may provide said energy from latent heat separate from said cooled air. Nevertheless, in an embodiment, said provided energy may be used to heat said cooled gaseous medium provided from the condenser. For example, dried, reheated gaseous medium may be recycled to the surroundings of a printing substrate.

For example, the energy transfer system may comprise a heat pump. For example, the heat pump may be adapted to provide, at a heating device side of the heat pump, a higher temperature than a temperature at a condenser side of the heat pump. In an embodiment, the energy transfer system employs a heat transfer fluid. Such an energy transfer fluid may be any fluid well known in the art for use as a heat transport fluid (e.g. the fluid known as R134a). It is however envisaged that advantageously carbon dioxide (as a heat transfer fluid also referred to as R744) may be employed in view of the temperature that may be reached in an embodiment of a drying device arranged in a printing apparatus.

Further, it is envisaged that energy may be retrieved not only from condensing evaporated liquid stemming from the printing substance, but also from the printing substrate that was heated to evaporate said liquid. So, in an embodiment, a printing apparatus is provided with a suitable heat pump to receive heat from a substrate at the moment that such substrate has been heated, e.g. for drying.

In another or further embodiment, energy may be retrieved from other parts of the printing apparatus. For example, heated gaseous medium may be cooled, and retrieved heat energy may be transferred to the heating device of the present invention. Similarly, employing a suitable heat transfer system such as a heat pump, heat energy may be retrieved from an environment of the printing apparatus and supplied to the heating device. The environment may be heated by the printing apparatus and may thus be cooled again, while at least partly reusing the earlier consumed energy.

In the embodiments as described above, the gaseous medium is preferably air.

Water based inks are particularly preferred as a marking substance because of their HS&E friendliness. In such cases, the main vaporous component in the embodiments as described above comprises water vapor.

In another aspect, the present invention relates to a printing system comprising a recording substrate treatment apparatus according to any one of the embodiments described above. The printing apparatus further comprises an inkjet printing module comprising an inkjet printing device, the inkjet printing device being adapted to jet droplets of an inkjet marking material, in particular an aqueous inkjet ink, to form an image on an image recording substrate.

In an embodiment, the printing system comprises a recording substrate treatment apparatus according to any one of the embodiments described above, wherein the (relative) humidity in the inkjet printing module is controlled with the aid of a humidifier and wherein the humidifier receives the discharge portion of the gaseous medium from the recording substrate treatment apparatus. Preferably, the recording substrate treatment apparatus as used in this embodiment does not comprise an energy transfer system, such as a condenser.

In this embodiment, the humid air generated in and discharged from the recording substrate treatment apparatus may contain a larger amount of moisture than the ambient air.

Hence, in order to obtain the desired (relative) humidity in the printing module (to prevent drying of the ink in the printing device) it is more energy efficient to use the (purified) discharged air from the substrate treatment apparatus as a feed flow to the humidifier, because less water has to be evaporated to reach the desired humidity than when ambient air is used.

In a further aspect of the present invention, there is provided a method of drying a recording substrate, comprising the steps of: fixing a sheet of a recording substrate comprising an image of a marking substance on an outer surface of a transporting mechanism by an underpressure force generated by a first suction device, the image facing upward relative to the outer surface of the transporting mechanism; transferring heat to the recording substrate with a heater configured to directly heat the recording substrate; blowing a gaseous medium at the outer surface of the transporting mechanism with a blower, the blower receiving the gaseous medium from the first suction device.

In an embodiment, at least a part of the flow of the gaseous medium provided by the blower is guided to the heater for cooling the heater.

In an embodiment, the method comprises an additional step of removing gaseous medium from the outer surface of the transporting mechanism by a second suction device arranged opposite the outer surface of the transporting mechanism, wherein the blower (additionally) receives the gaseous medium from the second suction device.

In an embodiment, the method comprises an additional step of discharging a portion of the gaseous medium before it is received by the blower.

In an embodiment, the method comprises an additional step of supplying fresh gaseous medium to the blower via a supply duct.

In an embodiment, the method comprises an additional step of controlling the flow rate of the gaseous medium generated by the second suction device.

In the present embodiment, the pressure in a flow of the gaseous medium generated by the blower is measured by using a pressure sensor. The flow of gaseous medium generated by the second suction device is adapted to control said pressure within a predetermined range.

In an embodiment, the method comprises an additional step of controlling a discharge portion of the gaseous medium.

In the present embodiment, the amounts of vaporous components present in the gaseous medium to be received by the blower is measured by using a sensor suitable for measuring such amounts, in particular a humidity sensor for measuring (relative) humidity of the gaseous medium. Based on the measured content of vaporous components in the gaseous medium relative to the saturation amounts of such components in the gaseous medium, a discharge portion of the gaseous medium is determined and controlled to bring the content of vaporous components in the gaseous medium within a predetermined range. When the vaporous component is water vapor, the discharge portion is adapted such that the (relative) humidity of the gaseous medium is within a predetermined range. For example, the relative humidity of the gaseous medium is controlled to be within the range of between 20% and 60%, preferably between 25% and 50%, more preferably between 30% and 45%.

In an embodiment, the method comprises an additional purification step.

In the present embodiment, the gaseous medium, in particular the discharge portion of the gaseous medium, is purified before discharging the gaseous medium (e.g. to the environment) or reusing it in the recording substrate treatment apparatus or anywhere else in the printing system. The purification step involves removing impurities, such as contaminants (dust, grease particles, etc) present in the gaseous medium.

In an embodiment, the method comprises an additional step of recovering energy from the gaseous medium, in particular the discharge portion of the gaseous medium.

In the present embodiment, the gaseous medium is received by an energy transfer system which may be arranged to recover the (latent) energy present in the gaseous medium and reuse such energy in the substrate treatment apparatus or anywhere else in the printing system.

According to an embodiment of the present invention, a recording substrate treatment apparatus, comprises: a transporting mechanism for transporting a sheet of a recording substrate; a first suction device configured to provide an underpressure force at an outer surface of the transporting mechanism and hold the recording substrate on the outer surface; a radiation heater configure to directly heat the recording substrate; and a blower configured to provide a flow of a gaseous medium at the outer surface of the transporting mechanism, wherein in operation the blower receives the gaseous medium from the first suction device.

According to an aspect of the recording substrate treatment apparatus according to the present invention, the blower comprises an impingement unit arranged for refreshing the gaseous medium at the outer surface of the transporting mechanism.

According to an aspect of the recording substrate treatment apparatus according to the present invention, in operation, at least a part of the flow of the gaseous medium provided by the blower is guided to the heater.

According to an aspect of the recording substrate treatment apparatus according to the present invention, a second suction device is arranged for removing the gaseous medium from the outer surface of the transporting mechanism and, in operation, the blower receives the gaseous medium from the second suction device.

According to an aspect of the recording substrate treatment apparatus according to the present invention, a discharge device is configured to discharge a portion of the gaseous medium before it is received by the blower.

According to an aspect of the recording substrate treatment apparatus according to the present invention, a supply duct is provided to supply fresh gaseous medium to the blower.

According to an aspect of the recording substrate treatment apparatus according to the present invention, a pressure sensor is arranged to measure the pressure in a flow of the gaseous medium generated by the blower and to control a flow rate of the gaseous medium generated by the second suction device.

According to an aspect of the recording substrate treatment apparatus according to the present invention, a sensor is arranged to measure the amount of a vaporous component present in the gaseous medium to be received by the blower and to control a discharge portion of the gaseous medium.

According to an aspect of the recording substrate treatment apparatus according to the present invention, the sensor is a humidity sensor, in particular a relative humidity sensor.

According to an aspect of the recording substrate treatment apparatus according to the present invention, a purifier is arranged to purify the gaseous medium, wherein the purifier is preferably arranged to receive the discharge portion of the gaseous medium.

According to an aspect of the recording substrate treatment apparatus according to the present invention, an energy transfer system is provided for recovering energy from the gaseous medium, wherein the energy transfer system is preferably arranged to receive the discharge portion of the gaseous medium.

According to an aspect of the recording substrate treatment apparatus according to the present invention, the energy transfer system comprises a condenser for removing a vaporous component, in particular water vapor, from the gaseous medium.

According to an embodiment of the present invention, a printing system comprises the recording substrate treatment apparatus according to their present invention, the printing apparatus further comprising an inkjet printing module comprising an inkjet printing device, the inkjet printing device being adapted to jet droplets of an inkjet marking material, in particular an aqueous inkjet ink, to form an image on an image recording substrate.

According to an aspect of the printing system according to the present invention, the humidity in the inkjet printing module is controlled with the aid of a humidifier and the humidifier receives the discharge portion of the gaseous medium from the recording substrate treatment apparatus.

According to an embodiment of the present invention, a method of drying a recording substrate comprises the steps of: fixing a sheet of a recording substrate comprising an image of a marking substance on an outer surface of a transporting mechanism by an underpressure force generated by a first suction device, the image facing upward relative to the outer surface of the transporting mechanism; transferring heat to the recording substrate with a heater configured to directly heat the recording substrate; blowing a gaseous medium at the outer surface of the transporting mechanism with a blower, the blower receiving the gaseous medium from the first suction device.

It should be noted that each of the aspects of the present invention can be used in each of the embodiments of the present invention either by themself or with other aspects of the present invention as would be understood to one having ordinary skill in the art.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 2A-2C are schematic representations of an inkjet marking device, wherein FIG. 2A and FIG. 2B illustrate the assembly of inkjet heads and FIG. 2C is a detailed view of a part of the assembly of inkjet heads;

DETAILED DESCRIPTION OF THE PREFERRED EMBODIMENTS

Figure 1:
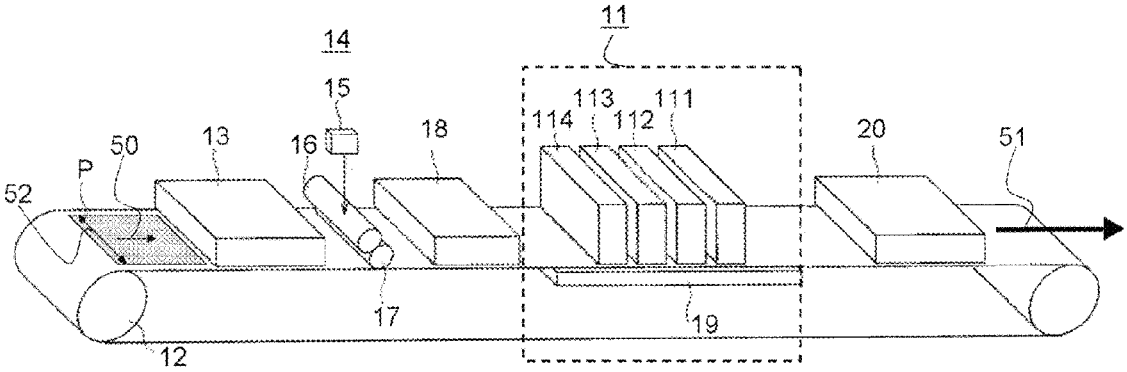
FIG. 1 is a schematic representation of an inkjet printing system.

The present invention will now be described with reference to the accompanying drawings wherein the same or similar elements have been identified with the same reference numerals.

Printing Process

A printing process in which the inks according to the present invention may be suitably used is described with reference to the appended drawings shown in FIG. 1 and FIG. 2. FIGS. 1 and 2 are schematic representations of an inkjet printing system and an inkjet marking device, respectively.

FIG. 1 shows that a sheet of a receiving medium, in particular a machine coated medium, P, is transported in a direction for conveyance as indicated by arrows 50 and 51 and with the aid of transportation mechanism 12. Transportation mechanism 12 may be a driven belt system comprising one (as shown in FIG. 1) or more belts. Alternatively, one or more of these belts may be exchanged for one or more drums. A transportation mechanism may be suitably configured depending on the requirements (e.g. sheet registration accuracy) of the sheet transportation in each step of the printing process and may hence comprise one or more driven belts and/or one or more drums. For a proper conveyance of the sheets of receiving medium, the sheets need to be fixed to the transportation mechanism. The way of fixation is not particularly limited and may be selected from electrostatic fixation, mechanical fixation (e.g. clamping) and vacuum fixation. Of these ways of fixing, vacuum fixation is preferred.

The printing process as described below comprises the following steps: media pre-treatment, image formation, drying and fixing and optionally post treatment.

Media Pre-Treatment

To improve the spreading and pinning (i.e. fixation of pigments and water-dispersed polymer particles) of the ink on the receiving medium, in particular on slow absorbing media, such as machine coated media, the receiving medium may be pretreated, i.e. treated prior to printing an image on the medium. The pre-treatment step may comprise one or more of the following:

- preheating of the receiving medium to enhance spreading of the used ink on the receiving medium and/or to enhance absorption of the used ink into the receiving medium;
- primer pre-treatment for increasing the surface tension of receiving medium in order to improve the wettability of the receiving medium by the used ink and to control the stability of the dispersed solid fraction of the ink composition (i.e. pigments and dispersed polymer particles). Primer pre-treatment may be performed in the gas phase, e.g. with gaseous acids such as hydrochloric acid, sulfuric acid, acetic acid, phosphoric acid and lactic acid, or in the liquid phase by coating the receiving medium with a pre-treatment liquid. The pre-treatment liquid may comprise water as a solvent, one or more cosolvents, additives such as surfactants and at least one compound selected from a polyvalent metal salt, an acid and a cationic resin; and
- corona or plasma treatment.

Primer Pre-Treatment

As an application way of the pre-treatment liquid, any conventionally known methods can be used. Specific examples of an application way include: a roller coating, an ink-jet application, a curtain coating and a spray coating. There is no specific restriction in the number of times with which the pre-treatment liquid is applied. It may be applied at one time, or it may be applied in two times or more. Application in two times or more may be preferable, since cockling of the coated printing paper can be prevented and the film formed by the surface pre-treatment liquid will produce a uniform dry surface having no wrinkles by applying in 2 steps or more.

Especially, a roller coating (see 14 in FIG. 1) method is preferable because this coating method does not need to take into consideration ejection properties and it can apply the pre-treatment liquid homogeneously to a recording substrate. In addition, the amount of the applied pre-treatment liquid with a roller or with other means to a recording substrate can be suitably adjusted by controlling: the physical properties of the pre-treatment liquid; and the contact pressure of a roller in a roller coater to the recording substrate and the rotational speed of a roller in a roller coater which is used for a coater of the pre-treatment liquid. As an application area of the pre-treatment liquid, it may be possible to apply only to the printed portion, or to the entire surface of both the printed portion and the non-printed portion. However, when the pre-treatment liquid is applied only to the printed portion, unevenness may occur between the application area and a non-application area caused by swelling of cellulose contained in the coated printing paper with the water in the pre-treatment liquid followed by drying. Then, from the viewpoint of drying uniformly, it is preferable to apply a pre-treatment liquid to the entire surface of a coated printing paper, and roller coating can be preferably used as a coating method to the whole surface. The pre-treatment liquid may be an aqueous pre-treatment liquid.

Corona or Plasma Treatment

Corona or plasma treatment may be used as a pre-treatment step by exposing a sheet of a receiving medium to corona discharge or plasma treatment. In particular when used on media like polyethylene (PE) films, polypropylene (PP) films, polyetyleneterephtalate (PET) films and machine coated media, the adhesion and spreading of the ink can be improved by increasing the surface energy of the media. With machine coated media, the absorption of water can be promoted which may induce faster fixation of the image and less puddling on the receiving medium. Surface properties of the receiving medium may be tuned by using different gases or gas mixtures as medium in the corona or plasma treatment. Examples are air, oxygen, nitrogen, carbondioxide, methane, fluorine gas, argon, neon and mixtures thereof. Corona treatment in air is most preferred.

FIG. 1 shows that the sheet of receiving medium P may be conveyed to and passed through a first pre-treatment module 13, which module may comprise a preheater, for example a radiation heater, a corona/plasma treatment unit, a gaseous acid treatment unit or a combination of any of the above. Optionally and subsequently, a predetermined quantity of the pre-treatment liquid is applied on the surface of the receiving medium P at pre-treatment liquid applying member 14. Specifically, the pre-treatment liquid is provided from storage tank 15 of the pre-treatment liquid to the pre-treatment liquid applying member 14 composed of double rolls 16 and 17. Each surface of the double rolls may be covered with a porous resin material such as sponge. After providing the pre-treatment liquid to auxiliary roll 16 first, the pre-treatment liquid is transferred to main roll 17, and a predetermined quantity is applied on the surface of the receiving medium P. Subsequently, the coated printing paper P on which the pre-treatment liquid was supplied may optionally be heated and dried by drying member 18 which is composed of a drying heater installed at the downstream position of the pre-treatment liquid applying member 14 in order to decrease the quantity of the water content in the pre-treatment liquid to a predetermined range. It is preferable to decrease the water content in an amount of 1.0 weight % to 30 weight % based on the total water content in the provided pre-treatment liquid provided on the receiving medium P.

To prevent the transportation mechanism 12 being contaminated with pre-treatment liquid, a cleaning unit (not shown) may be installed and/or the transportation mechanism may comprise multiple belts or drums as described above. The latter measure prevents contamination of the upstream parts of the transportation mechanism, in particular of the transportation mechanism in the printing region.

Image Formation

Image formation is performed in such a manner that, employing an inkjet printer loaded with inkjet inks, ink droplets are ejected from the inkjet heads based on the digital signals onto a print medium.

Although both single pass inkjet printing and multi pass (i.e. scanning) inkjet printing may be used for image formation, single pass inkjet printing is preferably used since it is effective to perform high-speed printing. Single pass inkjet printing is an inkjet recording method with which ink droplets are deposited onto the receiving medium to form all pixels of the image by a single passage of a receiving medium underneath an inkjet marking module.

In FIG. 1, 11 represents an inkjet marking module comprising four inkjet marking devices, indicated with 111, 112, 113 and 114, each arranged to eject an ink of a different color (e.g. Cyan, Magenta, Yellow and black). The nozzle pitch of each head is, e.g. about 360 dpi. In the present invention, "dpi" indicates a dot number per 2.54 cm.

Figure 2A:
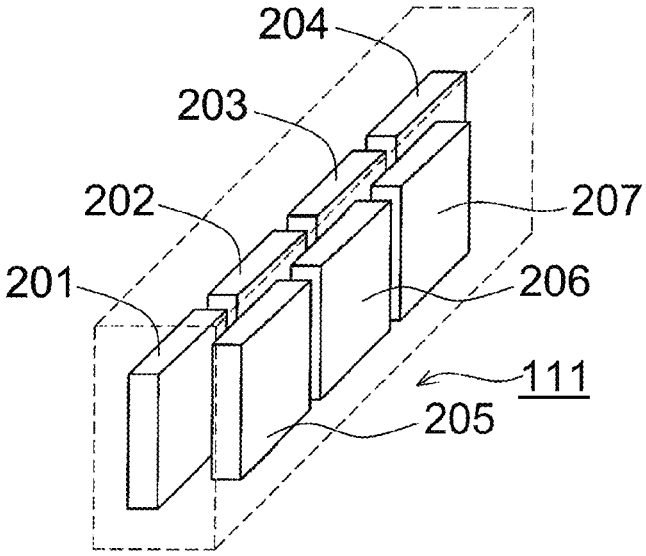
Figure 2B:
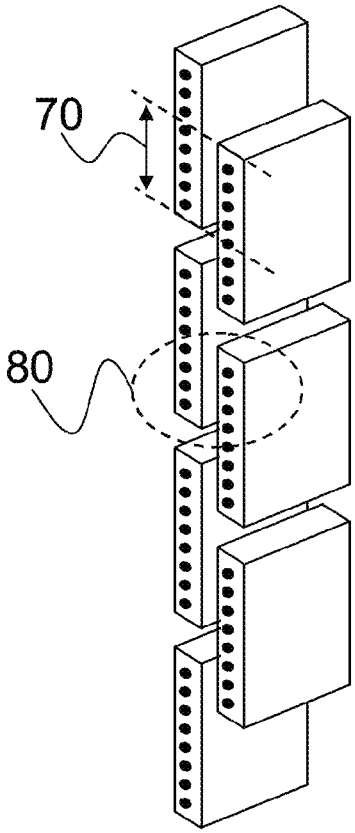
Figure 2C:
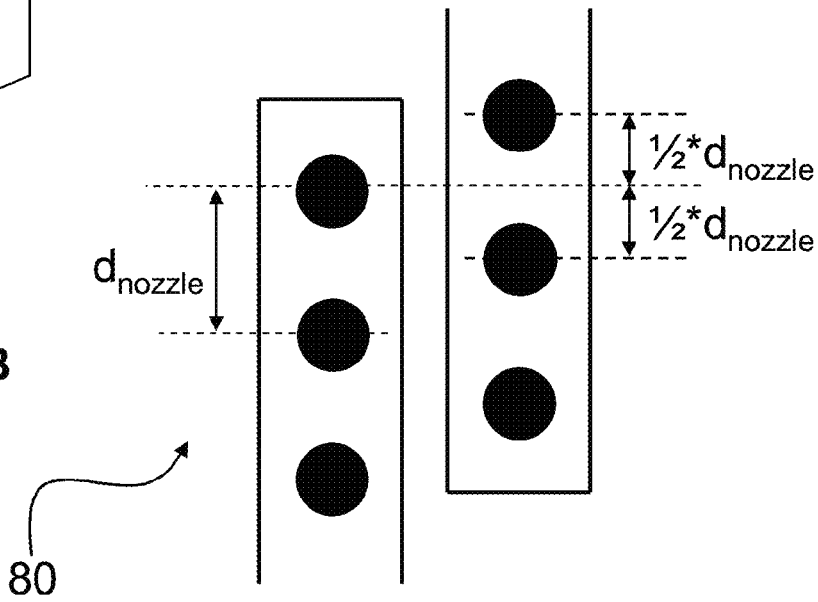

An inkjet marking device for use in single pass inkjet printing, 111, 112, 113, 114, has a length, L, of at least the width of the desired printing range, indicated with double arrow 52, the printing range being perpendicular to the media transport direction, indicated with arrows 50 and 51. The inkjet marking device may comprise a single printhead having a length of at least the width of said desired printing range. The inkjet marking device may also be constructed by combining two or more inkjet heads, such that the combined lengths of the individual inkjet heads cover the entire width of the printing range. Such a constructed inkjet marking device is also termed a page wide array (PWA) of printheads. FIG. 2A shows an inkjet marking device 111 (112, 113, 114 may be identical) comprising 7 individual inkjet heads (201, 202, 203, 204, 205, 206, 207), which are arranged in two parallel rows, a first row comprising four inkjet heads (201-204) and a second row comprising three inkjet heads (205-207), which are arranged in a staggered configuration with respect to the inkjet heads of the first row. The staggered arrangement provides a page wide array of nozzles, which are substantially equidistant in the length direction of the inkjet marking device. The staggered configuration may also provide a redundancy of nozzles in the area where the inkjet heads of the first row and the second row overlap, see 70 in FIG. 2B. Staggering may further be used to decrease the nozzle pitch (hence increasing the print resolution) in the length direction of the inkjet marking device, e.g. by arranging the second row of inkjet heads such that the positions of the nozzles of the inkjet heads of the second row are shifted in the length direction of the inkjet marking device by half the nozzle pitch, the nozzle pitch being the distance between adjacent nozzles in an inkjet head, $d_{nozzle}$ (see FIG. 2C, which represents a detailed view of 80 in FIG. 2B). The resolution may be further increased by using more rows of inkjet heads, each of which are arranged such that the positions of the nozzles of each row are shifted in the length direction with respect to the positions of the nozzles of all other rows.

In image formation by ejecting an ink, an inkjet head (i.e. printhead) employed may be either an on-demand type or a continuous type inkjet head. As an ink ejection system, there may be usable either the electric-mechanical conversion system (e.g., a single-cavity type, a double-cavity type, a bender type, a piston type, a shear mode type, or a shared wall type), or an electric-thermal conversion system (e.g., a thermal inkjet type, or a Bubble Jet type (registered trade name)). Among them, it is preferable to use a piezo type inkjet recording head which has nozzles of a diameter of 30 μm or less in the current image forming method.

FIG. 1 shows that after pre-treatment, the receiving medium P is conveyed to an upstream part of the inkjet marking module 11. Then, image formation is carried out by each color ink ejecting from each inkjet marking device 111, 112, 113 and 114 arranged so that the whole width of the receiving medium P is covered.

Optionally, the image formation may be carried out while the receiving medium is temperature controlled. For this purpose a temperature control device 19 may be arranged to control the temperature of the surface of the transportation mechanism (e.g. belt or drum) underneath the inkjet marking module 11. The temperature control device 19 may be used to control the surface temperature of the receiving medium P, for example in the range of 30° C. to 60° C. The temperature control device 19 may comprise heaters, such as radiation heaters, and a cooling device, for example a cold blast, in order to control the surface temperature of the receiving medium within said range. Subsequently and while printing, the receiving medium P is conveyed to the downstream part of the inkjet marking module 11.

Drying and Fixing

After an image has been formed on the receiving medium, the prints have to be dried and the image has to be fixed onto the receiving medium. Drying comprises the evaporation of solvents, in particular those solvents that have poor absorption characteristics with respect to the selected receiving medium.

FIG. 1 schematically shows a recording substrate treatment apparatus being a drying and fixing unit 20, which may comprise a heater, for example a radiation heater. After an image has been formed, the print is conveyed to and passed through the drying and fixing unit 20. The print is heated such that solvents present in the printed image, to a large extent water, evaporate. The speed of evaporation and hence drying may be enhanced by increasing the air refresh rate in the drying and fixing unit 20. Simultaneously, film formation of the ink occurs, because the prints are heated to a temperature above the minimum film formation temperature (MFT). The residence time of the print in the drying and fixing unit 20 and the temperature at which the drying and fixing unit 20 operates are optimized, such that when the print leaves the drying and fixing unit 20 a dry and robust print has been obtained. As described above, the transportation mechanism 12 in the fixing and drying unit 20 may be separated from the transportation mechanism of the pre-treatment and printing section of the printing apparatus and may comprise a belt or a drum.

Figure 3A:
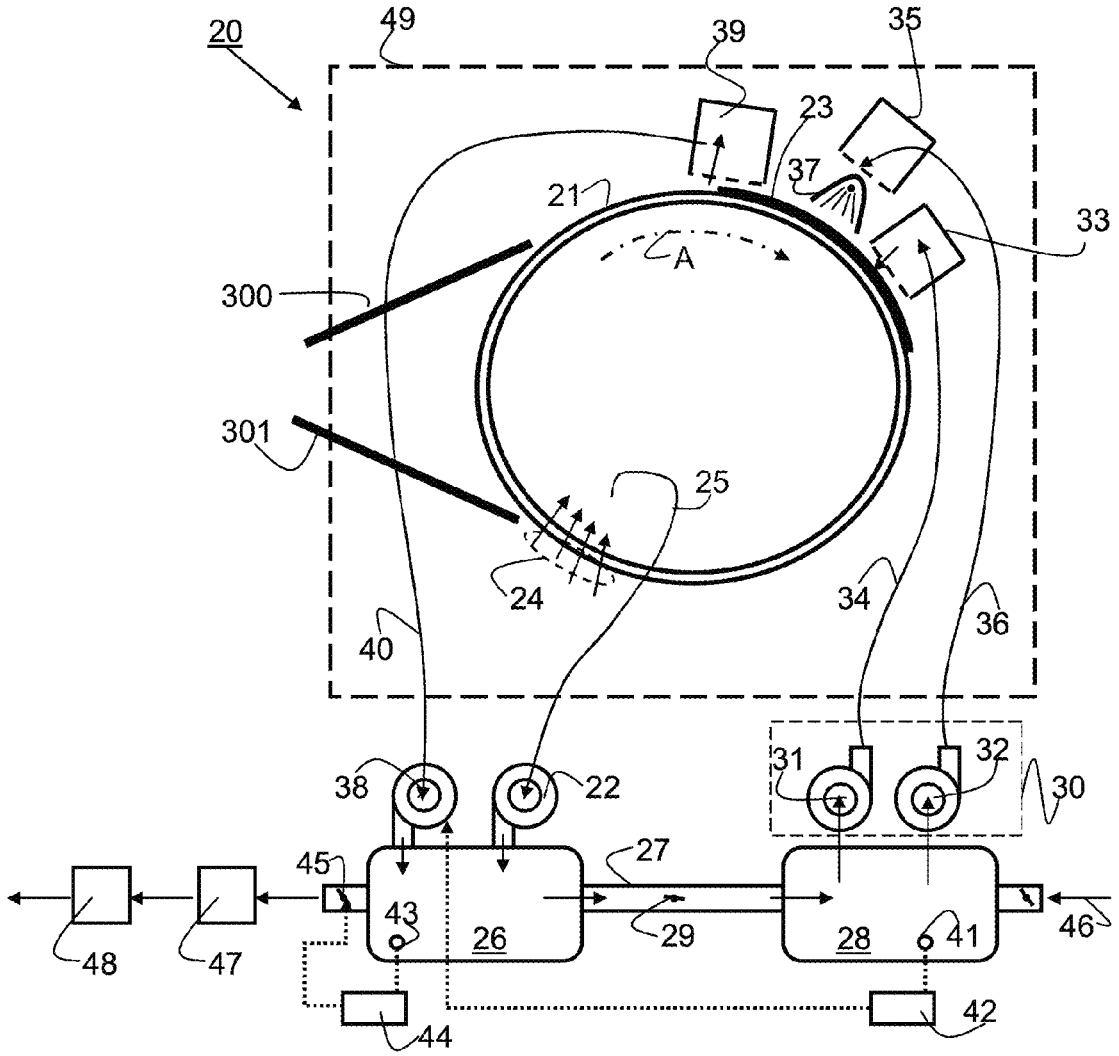
FIG. 3A is a schematic representation of a recording substrate treatment apparatus according to an embodiment of the present invention.

FIG. 3A is a schematic representation of a recording substrate treatment apparatus according to an embodiment of the present invention, being a drying and fixing unit 20 as also schematically shown in FIG. 1.

For clarity reasons, FIG. 3A does not show all ducts connecting the parts of the drying and fixing unit. The fluid connections and flows are indicated with solid arrows.

In order to create a more or less closed system, for reasons of energy efficiency, the fixing and drying unit 20 may comprise a housing, indicated with intermittent line 49.

The fixing and drying unit 20 comprises a transporting mechanism 21, in the present embodiment a drum which in operation rotates about its axial axis (not shown) in a direction indicated with arrow A. Alternatively, the transporting mechanism may be an endless belt. In either case, the outer surface of the transporting mechanism 21 is provided with a hole arranged for accommodating a suction flow for holding down a sheet of a recording substrate on the outer surface of the transporting mechanism by an underpressure force. In particular, a plurality of holes is arranged for this purpose. In operation, a sheet of a recording substrate enters the fixing and drying unit 20 at position 300 and leaves it at position 301. The fixing and drying unit 20 comprises a first suction device 22, in this particular embodiment an underpressure fan arranged for providing a first suction flow. The underpressure fan has an input side, which is in fluid connection with the hole or plurality of holes provided in the outer surface of the transporting mechanism 21. The hole (or plurality of holes) may extend from a first end located at the outer surface of the transporting mechanism 21 to a second end located in a closed chamber (not shown). The closed chamber may be in fluid connection with the input side of the first suction device 22. The closed chamber may comprise the entire interior of the transporting mechanism 21, in this example a transporting drum. The closed chamber may also be arranged at an inner surface of the transporting mechanism 21. Alternatively the closed chamber may be a suction box (not shown), which is arranged underneath a transporting belt provided with suction holes. In operation, a sheet of a recording material 23 is held down by an underpressure force and transported in the direction indicated with arrow A. At the parts of the outer surface of the transporting mechanism 21 that are not covered with a sheet of a recording substrate, air is sucked in towards the input of the first suction device 22, as is for example indicated with arrows 24. Thus, a first suction flow is generated as indicated with arrow 25. The first suction flow rate depends on the coverage of the outer surface of the transporting mechanism 21 with sheets of recording substrate 23. The output side of the first suction device is in fluid connection with an in-box 26. The in-box 26 is in fluid connection with an out-box 28 via a duct 27 comprising a valve 29, e.g. a butterfly valve. The out-box is in fluid connection with a blower 30, in this particular example comprising two blowing fans 31 and 32. The first blowing fan 31 is in fluid connection with a first impingement unit 33, as is indicated with arrow 34. The first impingement unit 33 is arranged for impinging air with the outer surface of the transporting mechanism 21 and in particular with a passing sheet of a recording substrate 23. The second blowing fan 32 is in fluid connection with a second impingement unit 35, as is indicated with arrow 36. The second impingement unit 35 is arranged for impinging air with a heater, in this particular example a radiation heater 37 (e.g. CIR). The radiation heater 37 is arranged to heat the outer surface of the transporting mechanism 21, in particular to heat a passing sheet of a recording substrate 23. The fixing and drying unit 20 further comprises a second suction device 38, comprising an inlet that is in fluid connection with an air removal device 39, as indicated with arrow 40. The second suction device 38 comprises an outlet that is in fluid connection with the in-box 26. The air removal device 39 is arranged opposite the outer surface of the transporting mechanism 21 and in operation removes air from the surroundings of the transporting mechanism 21, in particular from the vicinity of the outer surface of the transporting mechanism 21. In the embodiment shown in this particular example, the fixing and drying unit 20 comprises a pressure sensor 41 operatively connected to a first flow controller 42. Here, the pressure sensor 41 is located in the out-box 28. Alternatively, the pressure sensor 41 may be suitably located near the inlet of the outlet of either the first blowing fan 31 or the second blowing fan 32. The first flow controller 42 is operatively connected to the second suction device 38. When, in operation, the coverage of the outer surface of the transporting mechanism 21 increases, the first suction flow rate decreases. Consequently the flow rate of the blower 30 decreases, which decrease in flow rate can be monitored by measuring the pressure with pressure sensor 41. The air flows to the first impingement unit 33, indicated with arrow 34, and to the second impingement unit 35, indicated with arrow 36, will therefore decrease. The first may lead to insufficient refreshment of air at the outer surface of the transporting mechanism 21, in particular at locations where a sheet of a recording substrate is present, hence the drying capacity may decrease and even become insufficient. The second may lead to overheating of the heaters or, in case of lowering the heating power, to prevent overheating to insufficient drying capacity. To compensate for these effects, the air flow generated by the second suction device 38 is adapted (by the flow controller 42) to bring the pressure measured by the pressure sensor 41, within a predetermined range, in particular near the ambient pressure.

Figure 3B:
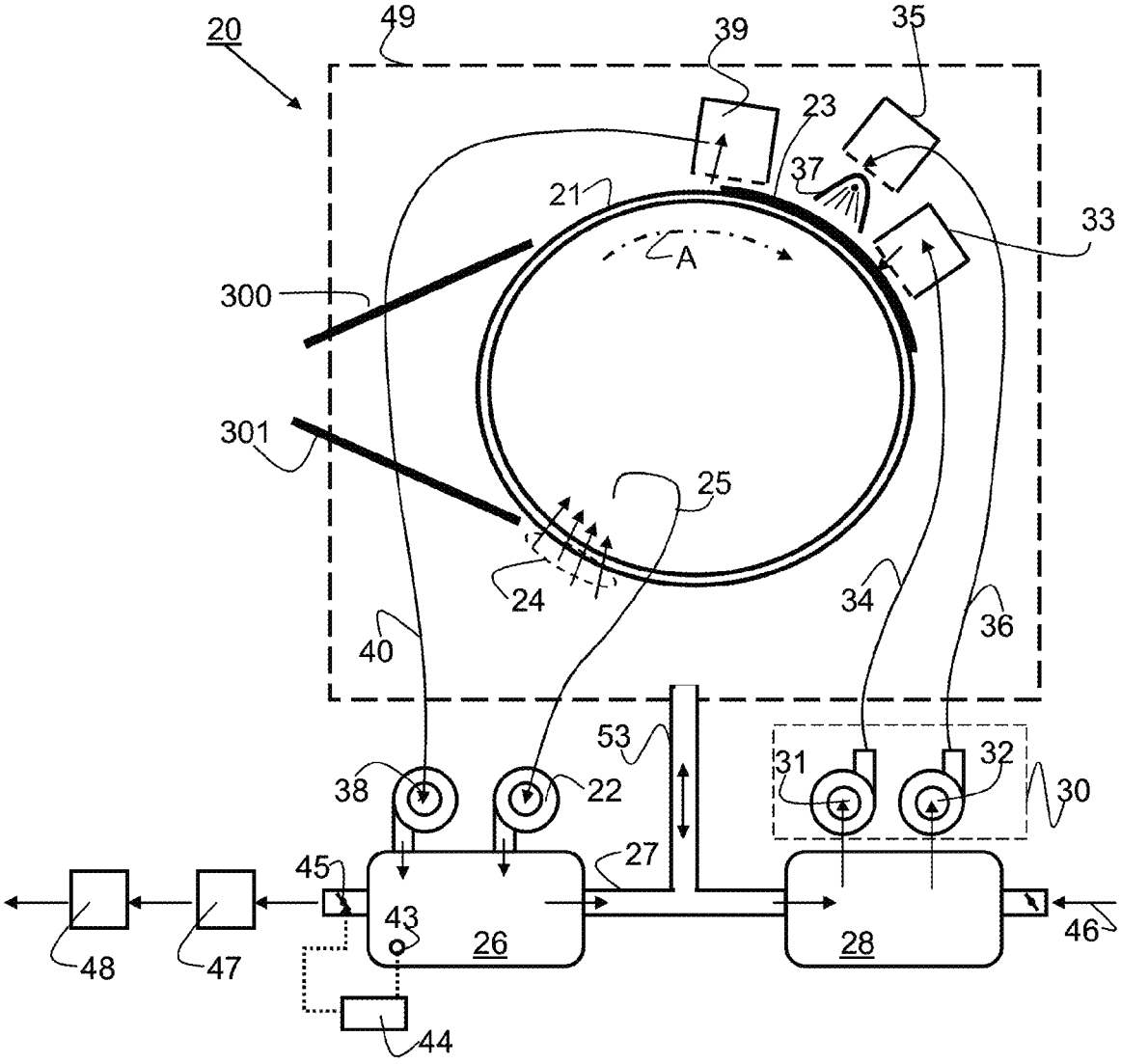
FIG. 3B is a schematic representation of a recording substrate treatment apparatus according to an embodiment of the present invention.

Alternatively, the pressure sensor 41 and the first flow controller 42 may be dispensed with and instead a short cut duct 53, as shown in FIG. 3B, may be arranged to fluidly connect the housing 49 with duct 27. Pressure differences between the interior of the housing 49 and duct 27 (which is in fluid connection with in-box 26 and out-box 28) that may arise during operation of the fixing and drying unit 20 will level automatically. Alternatively, short cut duct 53 may be arranged to fluidly connect the housing 49 directly with in-box 26 or out-box 28.

The fixing and drying unit 20 further comprises a humidity sensor 43, in particular a relative humidity sensor. The humidity sensor 43 is operatively connected to a second flow controller 44, which is operatively connected to a controllable valve 45, in particular a controllable butterfly valve. Alternatively, the (relative) humidity sensor may be suitably located in the inlet or outlet of the first suction device 22 and/or of the second suction device 38, or the sensor may be located in the out-box 28. In any case, depending on the (relative) humidity of the air circulating in the fixing and drying unit 20, the flow controller determines a discharge portion required to maintain the (relative) humidity of the circulating air within a predetermined range, e.g. between 20% and 60%, and controls the controllable valve 45 accordingly. Fresh make-up air may then be supplied to the out-box 28 for compensating for the discharged air, as is indicated with arrow 46.

Optionally, the discharged air may be purified by a purifier 47. The purifier may, for example be arranged to remove solid and liquid contaminants from the discharged air flow, e.g. dust, grease particles, marking substance residues, etc.

Optionally, energy may be recovered from the discharged air by an energy transfer system 48, for example a condenser. In a condenser, the discharged air is cooled below the dew point, such that condensation of the present vapors, in particular water vapor occurs. The condensation products are removed and cooled and dry air leaves the condenser. The recovered energy may be used, for example to heat the make-up air.

In the present example, the interior of the housing encompasses the transporting mechanism 21, the radiation heater 37, impingement units 33 and 35 and the air removal device 39. The blower 30, the first suction device 22, the second suction device 38, the optional purifier 47 and the optional energy transfer system may also be comprised in the interior of the housing.

The fixing and drying unit 20 may suitably comprise additional units, such as additional radiation heating devices and/or additional impingement units and/or additional air removal devices arranged around the circumference of the transporting mechanism 21 in order to further optimize the drying and fixing efficiency of the fixing and drying unit 20. The additional heating devices may be provided with additional impingement units for cooling each individual heating device. All additional units are in similar fluid connections as describe herein above.

Figure 4:
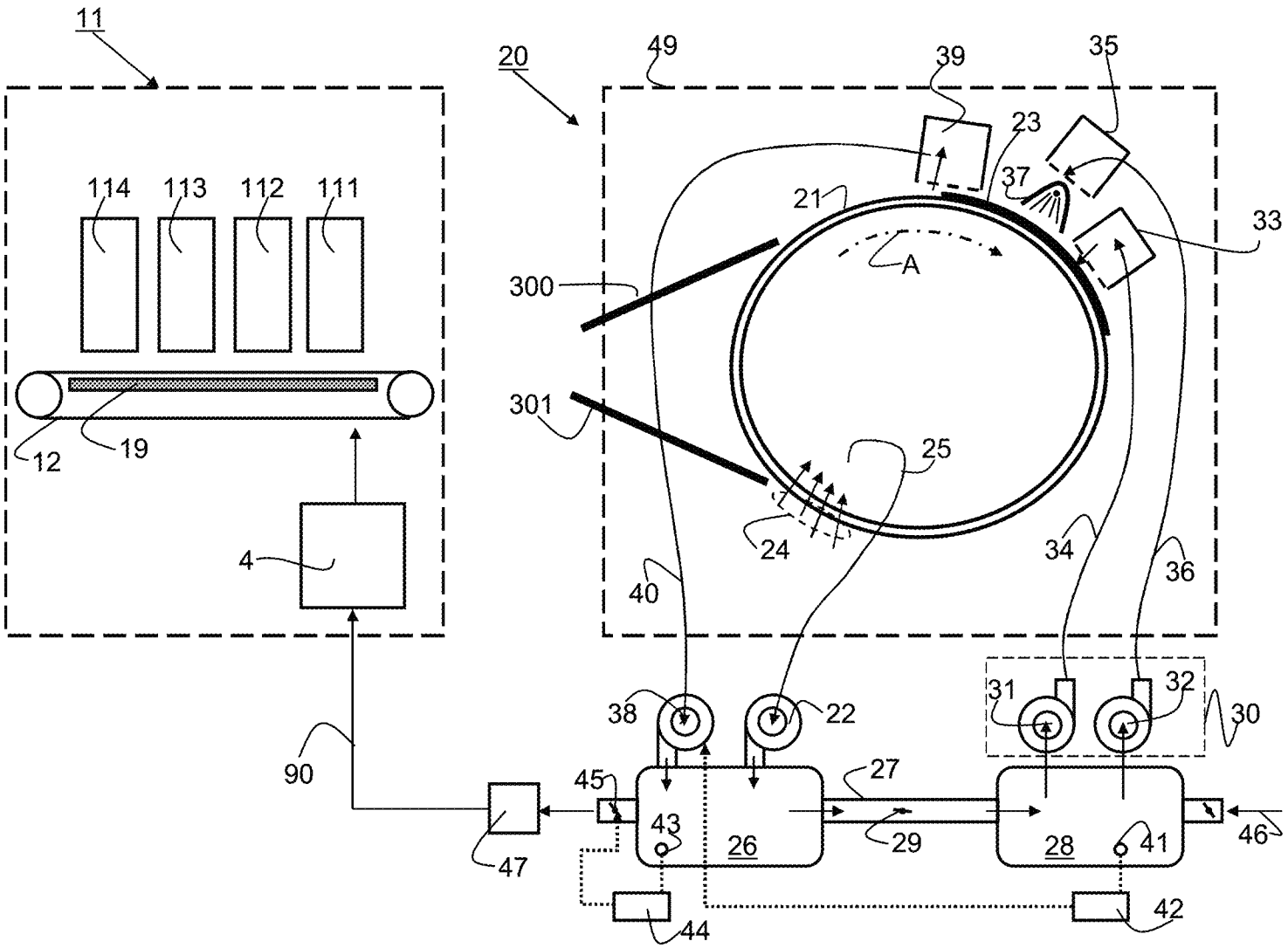
FIG. 4 is a schematic representation of a part of the inkjet printing system as shown in FIG. 1 comprising a recording substrate treatment apparatus according to an embodiment of the present invention.

FIG. 4 shows a schematic representation of a part of the inkjet printing system as shown in FIG. 1, comprising a recording substrate treatment apparatus being a fixing and drying unit 20 as shown in FIG. 3A. Alternatively, the embodiment as shown in FIG. 3B may be used in the present embodiment. In FIG. 3A, 11 represents an inkjet marking module comprising four inkjet marking devices, indicated with 111, 112, 113 and 114, as described above. The inkjet marking module comprises a humidifier 4 in order to control the (relative) humidity in the marking module, to prevent drying of the marking substance in the marking devices 111, 112, 113 and 114. To increase the efficiency of the humidifier 4, the humidifier 4 receives the purified discharge air from the fixing and drying module 20, as indicated with arrow 90. The discharge air usually has a higher (relative) humidity than the air in the surroundings of the printing device (ambient air). Therefore, the humidifier requires less energy to evaporate water to control the (relative) humidity of the air present in the inkjet marking module 11. Alternatively, the (moist) discharge air of the fixing and drying unit 20 may be introduced in the bulk air (i.e. total volume of air) present in the inkjet marking module 11, or the (moist) discharge air may be suitably used anywhere else in the printing system where an elevated (relative) humidity is required. Depending on the application, the moist discharge air of the fixing and drying unit 20 may be cooled or heated, prior to use in the printing system.

Post Treatment

To increase the print robustness or other properties of a print, such as gloss level, the print may be post treated, which is an optional step in the printing process.

In an embodiment, the prints may be post treated by laminating the prints.

In an embodiment, the post-treatment step comprises a step of applying (e.g. by jetting) a post-treatment liquid onto the surface of the coating layer, onto which the inkjet ink has been applied, so as to form a transparent protective layer on the printed recording substrate. In the post-treatment step, the post-treatment liquid may be applied over the entire surface of an image on the recording substrate or may be applied only to specific portions of the surface of an image. The method of applying the post-treatment liquid is not particularly limited, and is selected from various methods depending on the type of the post-treatment liquid. However, the same method as used in the coating method of the pre-treatment liquid or an inkjet printing method is preferably used. Of these methods, an inkjet printing method is particularly preferable in view of, avoiding contact between the printed image and the used post-treatment liquid applicator; the construction of an inkjet recording apparatus used; and the storage stability of the post-treatment liquid. In the post-treatment step, a post-treatment liquid containing a transparent resin is applied on the surface of a formed image so that a dry adhesion amount of the post-treatment liquid is 0.5 g/m2 to 10 g/m2, preferably 2 g/m2 to 8 g/m2, thereby forming a protective layer on the recording substrate. When the dry adhesion amount is less than 0.5 g/m2, almost no improvement in image quality (image density, color saturation, glossiness and fixability) is obtained. When the dry adhesion amount is more than 10 g/m2, it is disadvantageous in cost efficiency, because the dryness of the protective layer degrades and the effect of improving the image quality is saturated.

As a post-treatment liquid, an aqueous solution comprising components capable of forming a transparent protective layer over a recording substrate (e.g. a water-dispersible resin, a surfactant, water, and additives as required) is preferably used. The water-dispersible resin comprised in the post-treatment liquid, preferably has a glass transition temperature (Tg) of −30° C. or higher, and more preferably in the range of −20° C. to 100° C. The minimum film forming temperature (MFT) of the water-dispersible resin is preferably 50° C. or lower, and more preferably 35° C. or lower. The water-dispersible resin may be radiation curable to improve the glossiness and fixability of the image.

As the water-dispersible resin, for example, an acrylic resin, a styrene-acrylic resin, a urethane resin, an acryl-silicone resin, a fluorine resin and the like are preferably used. The water-dispersible resin can be suitably selected from the same materials as that used for the inkjet ink. The amount of the water-dispersible resin contained, as a solid content, in the protective layer is preferably 1% by mass to 50% by mass.

The surfactant comprised in the post-treatment liquid is not particularly limited and may be suitably selected from those used in the inkjet ink. Examples of the other components of the post-treatment liquid include antifungal agents, antifoaming agents, and pH adjustors.

Hitherto, the printing process was described such that the image formation step was performed in-line with the pre-treatment step (e.g. application of an (aqueous) pre-treatment liquid) and a drying and fixing step, all performed by the same apparatus (see FIG. 1). However, the printing process is not restricted to the above-mentioned embodiment. A method in which two or more machines are connected through a belt conveyor, drum conveyor or a roller, and the step of applying a pre-treatment liquid, the (optional) step of drying a coating solution, the step of ejecting an inkjet ink to form an image and the step of drying and fixing the printed image are performed. It is, however, preferable to carry out image formation with the above defined in-line image forming method.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually and appropriately detailed structure. In particular, features presented and described in separate dependent claims may be applied in combination and any combination of such claims are herewith disclosed.

Further, the terms and phrases used herein are not intended to be limiting; but rather, to provide an understandable description of the invention. The terms "a" or "an," as used herein, are defined as one or more than one. The term plurality, as used herein, is defined as two or more than two. The term another, as used herein, is defined as at least a second or more. The terms including and/or having, as used herein, are defined as comprising (i.e., open language). The term "in fluid connection" or "operatively connected," as used herein, are defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A recording substrate treatment apparatus, comprising:

a transporting mechanism configured to transport a sheet of a recording substrate;

a first suction device configured to provide an underpressure force at an outer surface of the transporting mechanism to hold the recording substrate on the outer surface of the transporting mechanism;

a heater configured for direct radiation heating of the recording substrate; and a blower configured to provide a flow of a gaseous medium at the outer surface of the transporting mechanism, wherein in operation the blower receives the gaseous medium from the first suction device.

2. The recording substrate treatment apparatus according to claim 1, wherein the blower comprises an impingement unit arranged for refreshing the gaseous medium at the outer surface of the transporting mechanism.

3. The recording substrate treatment apparatus according to claim 1, wherein in operation at least a part of the flow of the gaseous medium provided by the blower is guided to the heater.

4. The recording substrate treatment apparatus according claim 1, further comprising a second suction device arranged for removing the gaseous medium from the outer surface of the transporting mechanism and wherein in operation the blower receives the gaseous medium from the second suction device.

5. The recording substrate treatment apparatus according to claim 1, further comprising a discharge device configured to discharge a portion of the gaseous medium before the gaseous medium is received by the blower.

6. The recording substrate treatment apparatus according to claim 1, further comprising a supply duct configured to supply fresh gaseous medium to the blower.

7. The recording substrate treatment apparatus according to claim 4, further comprising a pressure sensor arranged to measure the pressure in a flow of the gaseous medium generated by the blower and to control a flow rate of the gaseous medium generated by the second suction device.

8. The recording substrate treatment apparatus according to claim 5, further comprising a sensor arranged to measure the amount of a vaporous component present in the gaseous medium to be received by the blower and to control a discharge portion of the gaseous medium.

9. The recording substrate treatment apparatus according to claim 8, wherein the sensor is a humidity sensor.

10. The recording substrate treatment apparatus according to claim 9, wherein the humidity sensor is a relative humidity sensor.

11. The recording substrate treatment apparatus according to claim 1, further comprising a purifier arranged to purify the gaseous medium.

12. The recording substrate treatment apparatus according to claim 11, wherein the purifier is arranged to receive the discharge portion of the gaseous medium.

13. The recording substrate treatment apparatus according to claim 1, further comprising an energy transfer system for recovering energy from the gaseous medium, wherein the energy transfer system is preferably arranged to receive the discharge portion of the gaseous medium.

14. The recording substrate treatment apparatus according to claim 13, wherein the energy transfer system is arranged to receive the discharge portion of the gaseous medium.

15. The recording substrate treatment apparatus according to claim 13, wherein the energy transfer system comprises a condenser for removing a vaporous component from the gaseous medium.

16. The recording substrate treatment apparatus according to claim 15, wherein the vaporous component is water.

17. A printing system comprising:

the recording substrate treatment apparatus according to claim 1;

an inkjet printing module comprising an inkjet printing device, the inkjet printing device being adapted to jet droplets of an inkjet marking material to form an image on an image recording substrate.

18. The printing system according to claim 17, wherein the humidity in the inkjet printing module is controlled with the aid of a humidifier and wherein the humidifier receives the discharge portion of the gaseous medium from the recording substrate treatment apparatus.

19. A method of drying a recording substrate, the method comprising the steps of:

fixing a sheet of a recording substrate comprising an image of a marking substance on an outer surface of a transporting mechanism by an underpressure force generated by a first suction device, the image facing upward relative to the outer surface of the transporting mechanism;

transferring heat to the recording substrate with a heater configured for direct radiation heating of the recording substrate; and blowing a gaseous medium at the outer surface of the transporting mechanism with a blower, the blower receiving the gaseous medium from the first suction device.

* * * * *